US005599236A

United States Patent [19]

File

[11] Patent Number: 5,599,236

[45] Date of Patent: Feb. 4, 1997

[54] BUMPER BOWLING SYSTEM

[76] Inventor: Jon P. File, P.O. Box 1824, Kamuela, Hi. 96743

[21] Appl. No.: 242,309

[22] Filed: May 13, 1994

Related U.S. Application Data

[63] Continuation-in-part of Ser. No. 922,721, Jul. 31, 1992, Pat. No. 5,449,326.

[51] Int. Cl.[6] ..... A63D 5/00

[52] U.S. Cl. ..... 473/55; 473/113; 473/115

[58] Field of Search ..... 473/31, 32, 55, 473/113, 115; 293/107, 108; 73/1 D, 1 DV, 11

[56] References Cited

U.S. PATENT DOCUMENTS 3,401,933 9/1968 Conklin ..... 473/113

*Primary Examiner*—William M. Pierce
*Attorney, Agent, or Firm*—Gunn, Lee & Miller, PC

[57] ABSTRACT

A bumper bowling system is provided that eliminates the function of bowling lane gutters and uses bumpers to maintain a bowling ball within the confines of a bowling lane through to contact with the bowling pins. The bumper bowling system provides hardware, electronic circuitry, and software modifications in conjunction with scoring displays to provide a system of original manufacture or retrofit for existing automatic bowling scoring systems. Specifically, the system provides a bumper, a means for detecting when a ball strikes the bumper and at what location, a signalling display means generally running parallel to the bumper and the detection means, and the hardware necessary to position these devices along the length of each side of a standard bowling lane. In addition, the system utilizes appropriate circuitry for interfacing both the sensor means and the light display means with standard scoring control units. The hardware of the system allows for the use of targets in modifying the standard method of play for bowling. A variety of game play methods are disclosed which utilize to a greater or lesser extent the target display and sensor contact capabilities of the system.

45 Claims, 8 Drawing Sheets

BUMPER BOWLING SYSTEM

FIELD OF THE INVENTION

A system and method for bowling, specifically a system comprising the use of bumpers, sensors and means in place of a gutter, to deflect a bowling ball leaving the lane back into the lane and to permit methods of bowling that use contact with the bumpers as elements scoring.

BACKGROUND OF THE INVENTION

This is a continuation of part of co-pending patent Ser. application 07/922,721 filed Jul. 31, 1992, now U.S. Pat. No. 5,449,326, and incorporates the text and specifications herein by reference of the patent application.

SUMMARY OF THE INVENTION

Bowling is an immensely popular sport. However, it has its limitations. The physically handicapped, children, elderly and the like frequently end up throwing gutter bowls as they have neither the experience nor the strength and coordination to roll the bowling ball straight down the alley.

The applicant provides a bumper bowling system which eliminates the function of gutters and uses bumpers to keep a ball rolling down the lane out of the gutter and on the lane. Applicant's bumper bowling system provides hardware, electronic circuitry and software in conjunction with a scoring display to provide a bumper bowling system which may easily be retrofitted into existing bowling alleys, provides a bumper, a means to detect a ball striking a bumper, and a signal means, typically a light display running almost the length of the lane. This, combined with novel electronic circuitry, scoring and software provides for the user a variety of games to select from and further provides a brilliant light display, the nature of which is sometimes a function of ball activation of the sensor means, the games selected, and other variables.

Applicant's novel light display combined with a multiple of options and games selected provides the heretofore unavailable, versatile, exciting bowling based game.

Further, unlike other bumper bowling systems, applicant's system allows traditional bowling and new bumper bowling games to be played on the same lane at the same time. Bowlers can choose from a variety of new and different games to try. "Gutter balls" no longer frustrate the novice. Moreover, applicant's new bowling game will interface with existing computerized scoring systems for ease of installation and use.

The following is a brief description of the variety of games available from applicant's unique bowling system. First, traditional bowling may be selected wherein a bowling ball striking the bumper simulates a gutter ball, zeros the score, and resets the pins for the next frame. Secondly, a traditional bowling game may be scored with the exception that no ball striking the bumper would be counted as a gutter ball. Third, the scoring could be set up such that straight shots count as gutter balls and the bowler must use at least one bumper before the ball strikes the pins. This variation would use traditional scoring, just zeroing out any shot in which no bumper was struck.

Additionally, scores may be stored such that they may be "called up" even days later, by the bowler or a competitor, who may not "see" the final score but only frame by frame results —just as if the competitors were playing contemporaneously.

A unique feature of applicant's system is a sensor and a signal means running the length of the lane adjacent each edge of the lane and providing a lighted segment adjacent the bumper, which, if struck would double (triple, etc.) the score of the bowler. It is to be noted here that the length of the segment is variable, the shorter the segment the more difficult the shot. Applicant's system has a means of varying the width of the lighted sections and thus handicapping a weaker player against a stronger player.

Yet another variation of scoring of applicant's sections is to provide alternately lit and unlit sections creating a multiplicity of segments along the bumper and thus providing score differentials for the various segments which, when struck, would provide the score as a function of the segment struck. These segment values could change from frame to frame or randomly during the time the bowler takes his shot thus, introducing an element of "luck".

Thus it is seen how applicant provides a unique system comprising a visual display used in conjunction with a game selection scoreboard and a scoring display, data storage and a central processing unit to provide a heretofore unavailable variety of games to the user.

DETAILED DESCRIPTION OF THE PREFERRED EMBODIMENT

Applicant's Bumper Bowling System is comprised fundamentally of certain hardware, electronics including control circuitry and a microprocessor/CPU, as well as software for programming the electronics and cooperating with the control circuitry to provide for a variety of scoring methods for bumper bowling games and a variety of signal displays.

Figure 1:
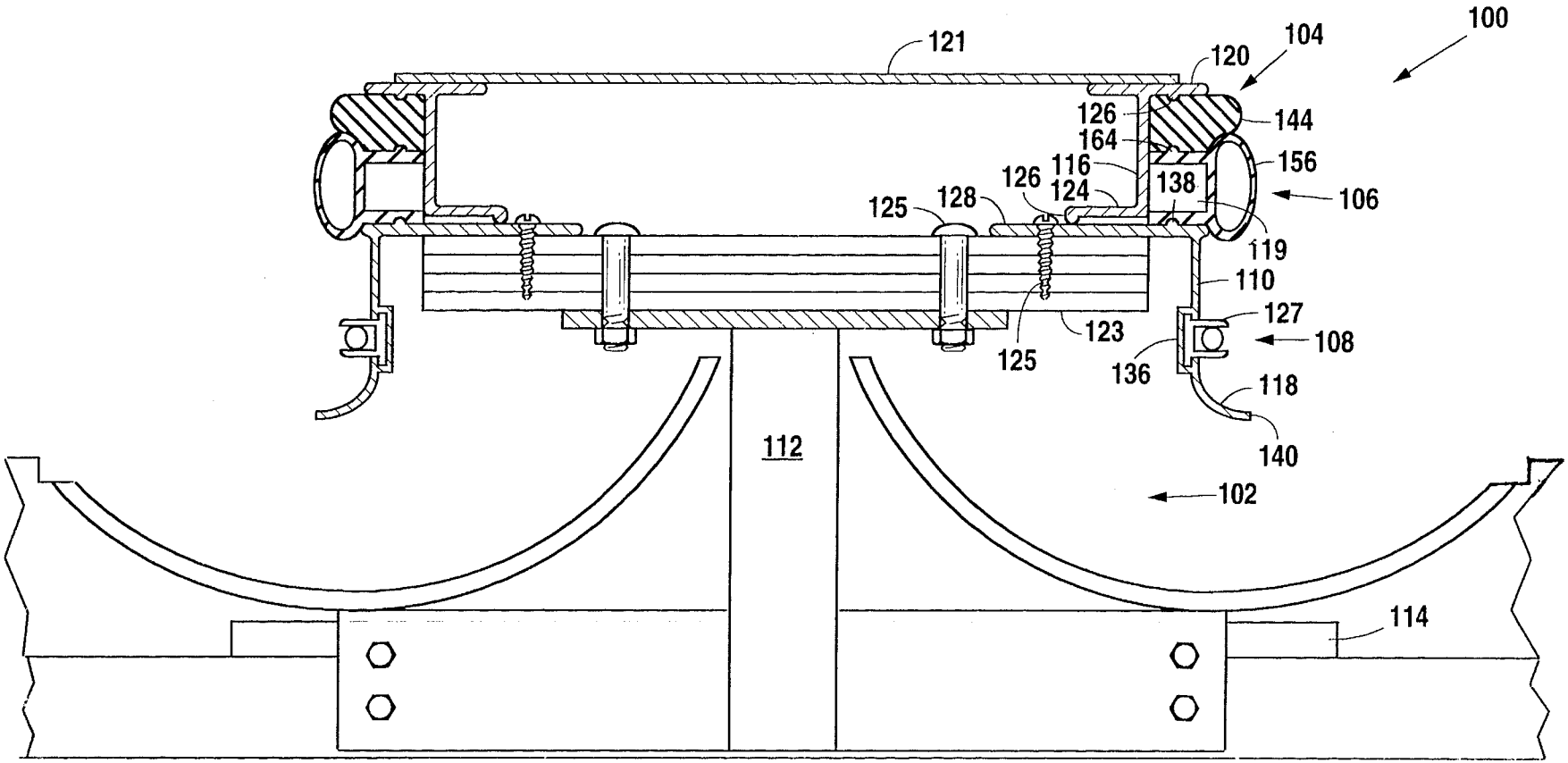
FIG. 1 is a cross-sectional view of the bumper, mounting bracket, and gutter assembly of the present invention.

Turning now to the hardware of Applicant's Bowling System and with particular reference to FIG. 1, it is seen that system hardware (100) includes a rigid frame (102), the frame supporting bumper means (104), adjacent to which is mounted sensor means (106) as well as signal means (108). These elements are located on frame (102) in such a manner as to lay adjacent an edge of the bowling lane such that bumper means (104) and/or sensor means (106) preclude the gutter and prevent a bowling ball from settling into the gutter, instead deflecting it back into the lane.

Reference to FIG. 1 illustrates that frame (102) is comprised of a rail (110) atop a mounting bracket (112), which firmly mounts the rail, having bumper means (104), sensor means (106) and signal means (108) thereon, to a floor of the bowling alley. Alternatively, the assembly of the present invention could be mounted to a hard floor surface outside of a conventional bowling alley in either temporary or permanent fashion as in a gymnasium or as in an open area such as a parking lot. The use of a spacer (114), as necessary, allows variation of the height of rail (110) above the floor. More specifically, spacer (114) should be used when necessary to mount frame (102) such that bumper means (104) is approximately 5½ inches above the surface of the lane. This distance is slightly more than the radius of a typical American Bowling Congress approved bowling ball. Frame (102) is mounted such that bumper means (104) is typically 4⅛" laterally adjacent the edge of the lane.

With further reference to FIG. 1, it is seen that rail (110) is comprised of two sections, an upper sub-rail (116) and a lower sub-rail (118), the two joined together by fasteners (not shown) such as screws or the like. Bumper means (104) and sensor means (106) are sandwiched or compressed between portions of upper sub-rail (116) and lower sub-rail (118) as more specifically set forth below. A support block (119), such as a 1"×1" length of wood, acts as a support backing to sensor means (106) and a base for bumper means (104). Lower sub-rail (118) contains, affixed thereto signal means (108) on a depending portion thereof, as more particularly set forth below (see FIGS. 3 and 6).

Note how bumper means (104), sensor means (106), signal means (108), rail (110), upper sub-rail (116), and lower sub-rail (118) have left-hand and right-hand versions as viewed in FIG. 1. This is required, of course, for adjacent alleys. Thus, it is seen that frame (102) supports two rail assemblies as illustrated in FIG. 1. Further, it is seen that a lane divider cap (121) extends across the top of adjacent rails (110). Further, it is seen how a support member (123), here a 16"×6"×1⅛" piece of plywood, supports rails (110) fastened to a surface thereof by fasteners (125) such as screws or the like.

Figure 2:
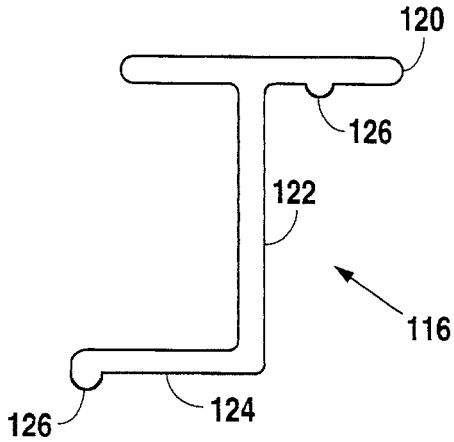
FIG. 2 is a detailed cross-sectional view of the upper sub-rail of the present invention which assists in the retention of the bumper air tube for the present invention.
Figure 3:
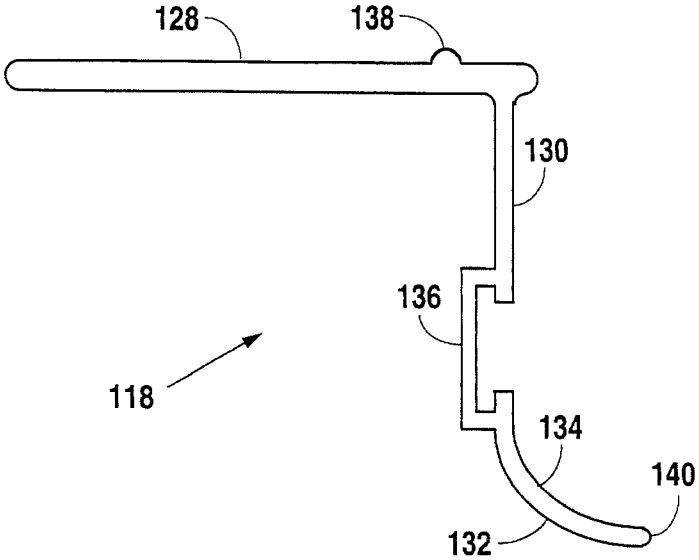
FIG. 3 is a detailed cross-sectional view of the lower sub-rail of the present invention which facilitates the retention of the bumper, air tube, and signal means of the present invention.

Turning now to FIGS. 1, 2 and 3 for details of rail (110), it is seen with reference to FIGS. 1 and 2 how sub-rail (116) is generally "J-shaped," typically made of extruded aluminum and has a base arm (120) with a leg (122) depending therefrom and a foot (124) extending from the distal end of leg (122). Foot (124) has on the distal end thereof a boss or standoff (126). Boss or standoff (126) is also located on an underside of base arm (124) set forth in FIG. 2.

With references to FIGS. 1 and 3, details of lower sub-rail (118) may be appreciated. Lower sub-rail (118) is generally "J-shaped" and made of extruded aluminum. Lower support rail (118), with reference to FIG. 3, is seen to comprise a base arm (128) with a leg (130) depending from one end thereof. Leg (130) is seen to have a curved portion (132) at the distal end thereof and a polished portion (134) which provides for an effective reflective surface as discussed more fully below. A portion of leg (130) is comprised of walls defining a channel (136). The distal end of leg (130) is comprised of a tip (140). With reference to FIG. 1, it is seen how tip (140) may protect signal means (108) which lies adjacent channel (136) from being struck by a bowling ball as tip (140) extends beyond signal means (108). In this regard, it is noted that a bracket (127) engages channel (136) and provides a means for securing signal means (108) to lower sub-rail (118).

Figure 4:
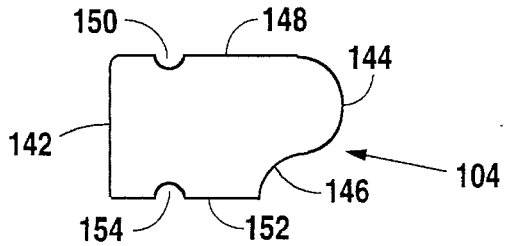
FIG. 4 is a detailed cross-sectional view of the bumper means of the present invention.

Reference to FIGS. 1 and 4 illustrate the details of bumper means (104) and how it is Joined to frame (102). More specifically, FIG. 4 illustrates that bumper means (104), typically made of solid rubber and preferably a special compound known as Kirkhill Compound #550C3226, having an anticipated life of about five years under normal use, ozone resistant, shore A50 to 60, high rebound with minimal compression set and does not mark objects that rub on the bumper —especially bowling balls, is shaped to have a flat rear wall (142) and a curved front wall (144), the latter having a cut-out (146) to accommodate an adjoining air tube as illustrated in FIG. 1. An upper wall (148) of bumper means (104) contains a notch (150) for receipt of boss (126) of base arm (120) (see FIG. 2) therein to help locate and stabilize bumper means (104) between upper sub-rail (116) and lower sub-rail (118).

Turning now to FIG. 4, and with reference to bumper means (104) it is seen that a lower wall (152) likewise has a notch (154) dimensioned similarly to that of notch (150). The purpose of this notch is, likewise, to help locate and fix the bumper means positionally with respect to rail (110) and sensor means (106).

Figure 5:
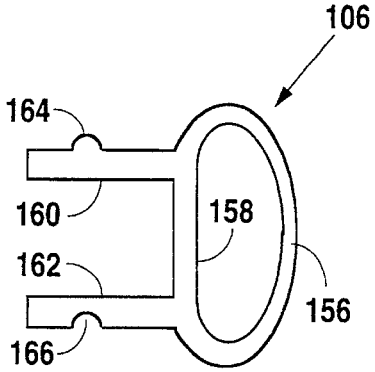
FIG. 5 is a detailed cross-sectional view of the sensor means (air tube) of the present invention.

Turning now to FIG. 5 and also with reference to FIG. 1, it is seen how sensor means (106) is preferably comprised of here, illustrated, an air tube with walls defining a tube (156) having a back wall (158). Extending transverse to back wall (158) is an upper leg (160) and a lower leg (162), upper leg (160) having a boss (164) thereon and lower leg (162) having a notch (166) therein. The function of the sensor means is to detect or sense a ball striking bumper means (104), which sensing is ultimately converted to an electrical signal for incorporation to the electronic circuitry as set forth more fully below. Sensing means may be contact tape, pressure sensitive elements or, as here, an air tube which is combined to activate an air switch as set forth more fully below with reference to FIG. 10.

The use of boss (124) and notch (166) is apparent with reference to FIG. 1 and designed to maintain sensor means (106) attached to frame (102) and adjacent bumper means (104). Note with reference to FIG. 5, the rectangular cross-section of the area defined and enclosed by upper leg (160), lower leg (162) and back wall (158). Typically, wooden support block (119) dimensioned to fit within the aforesaid area is provided to help secure bumper means (102) and sensor means (106) between base arm (120) of upper sub-rail (116) and base arm (128) of lower sub-rail (118) as illustrated in FIG. 1.

Note with reference to FIG. 1 that foot (124) of upper sub-rail (116) is fastened against the upper surface of base arm (128) of lower sub-rail (118) with bumper means (104), sensor means (106) and support block (119) located therebetween such that the notches and bosses engage one another; a compression fit can be affected with the resiliency of bumper means (104) absorbing some of the compression.

Figure 6:
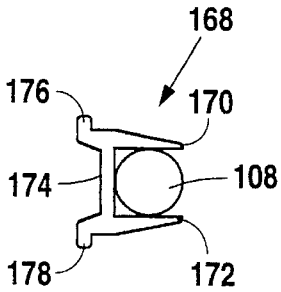
FIG. 6 is a detailed cross-sectional view of the signal means of the present invention.

Turning now to FIG. 6 and with reference also to FIG. 1, it is noted that signal means (108) is typically tubular, here shown to be circular in cross-section and is usually made up of discrete light sources within a clear tube, the tube and/or lights themselves being either colorless or tinted red, blue, green, etc. Signal means (108) is affixed to lower sub-rail (118) at channel (136) through use of bracket (127). More specifically, bracket (127) is comprised of an upper leg (170) and a lower leg (172) both trending perpendicular to a transverse rear wall (174) as set forth in FIG. 6. The distance between the inner surfaces of upper leg (170) and lower leg (172) is just slightly less than the light source carrying tube comprising signal means (108) such that there is a snug fit between legs (170) and (172). Bracket (127) is typically made of clear plastic and is somewhat flexible, and is dimensioned such that an upper arm (176) and a lower arm (178) extending perpendicular from rear wall (174) engage channel (136) in sliding fashion from one end of lower sub-rail (118). That is, material comprising bracket (127) comes in elongated strips, typically 18 feet in length, as does upper and lower sub-rails (116) and (118). The use of 18-foot lengths allows three sections to be used along on the edge of a 57-foot alley, with 3 feet left over to use as a taper section as set forth more fully below with reference to FIG. 8 below.

Figure 7A:
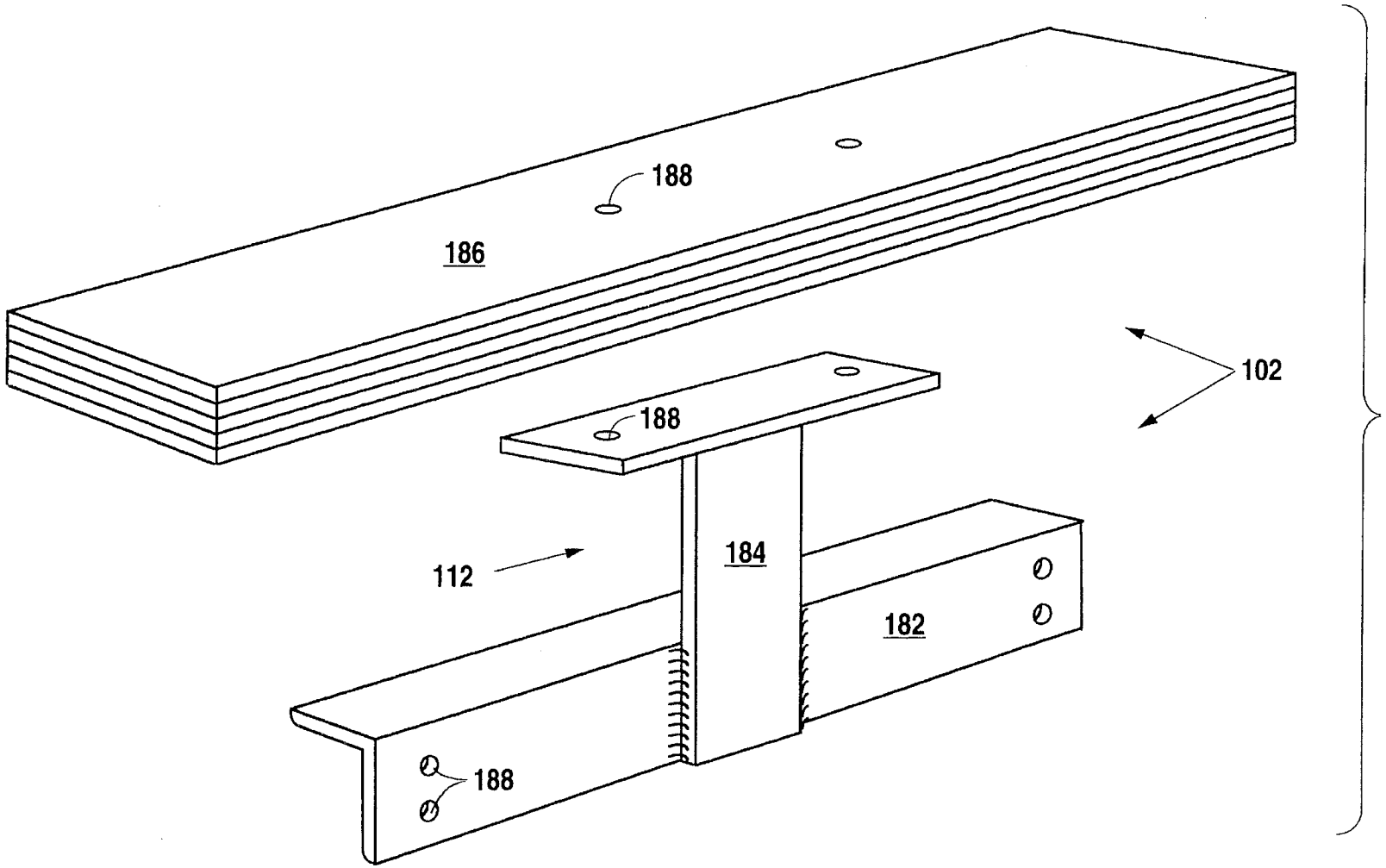
FIG. 7*a* is an exploded perspective view of the center lane divider mounting bracket of the present invention.
Figure 7B:
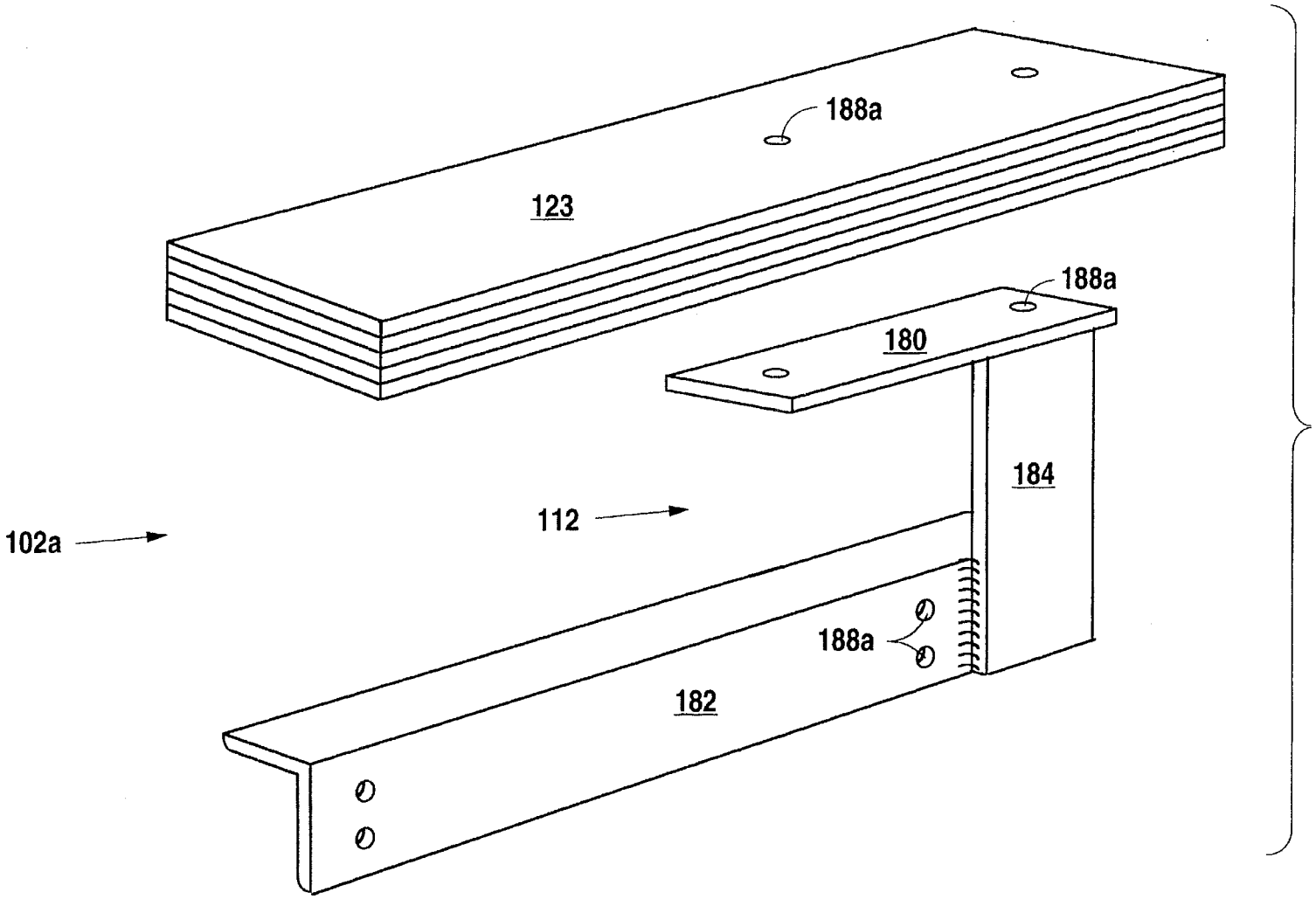
FIG. 7*b* is an exploded perspective view of the end lane mounting bracket of the present invention.

FIGS. 7A and 7B as viewed in conjunction with FIG. 1, illustrate the use of either frame (102) or end lane mounting frame (102*a*) in anchoring of the hardware of Applicant's system to a floor of the bowling alley. Specifically, FIG. 7A illustrates frame (102) having mounting bracket (112) and support member (123) releasably attachable thereto. FIG. 7A illustrates mounting bracket (112) having an upper leg (180) trending parallel to a lower leg (182), the lower leg being L-shaped in profile for attachment to 2"×4", 2"×6" or 2"×8" cribbing in the alleyway floor, legs (180) and (182) being made out of ⅛–¼ inch steel and attached to a perpendicular upright (184). Holes (188) are used for the receipt of standard fasteners such as nuts and bolts or screws therethrough to anchor the elements as shown.

FIG. 7B illustrates the use of lane mounting frame (102*a*) for engaging the hardware of Applicant's system to an end lane (i.e. a lane without an adjacent lane). As illustrated, frame (102*a*) is simply "half" of frame (102) with extra holes (188*a*).

Figure 8:
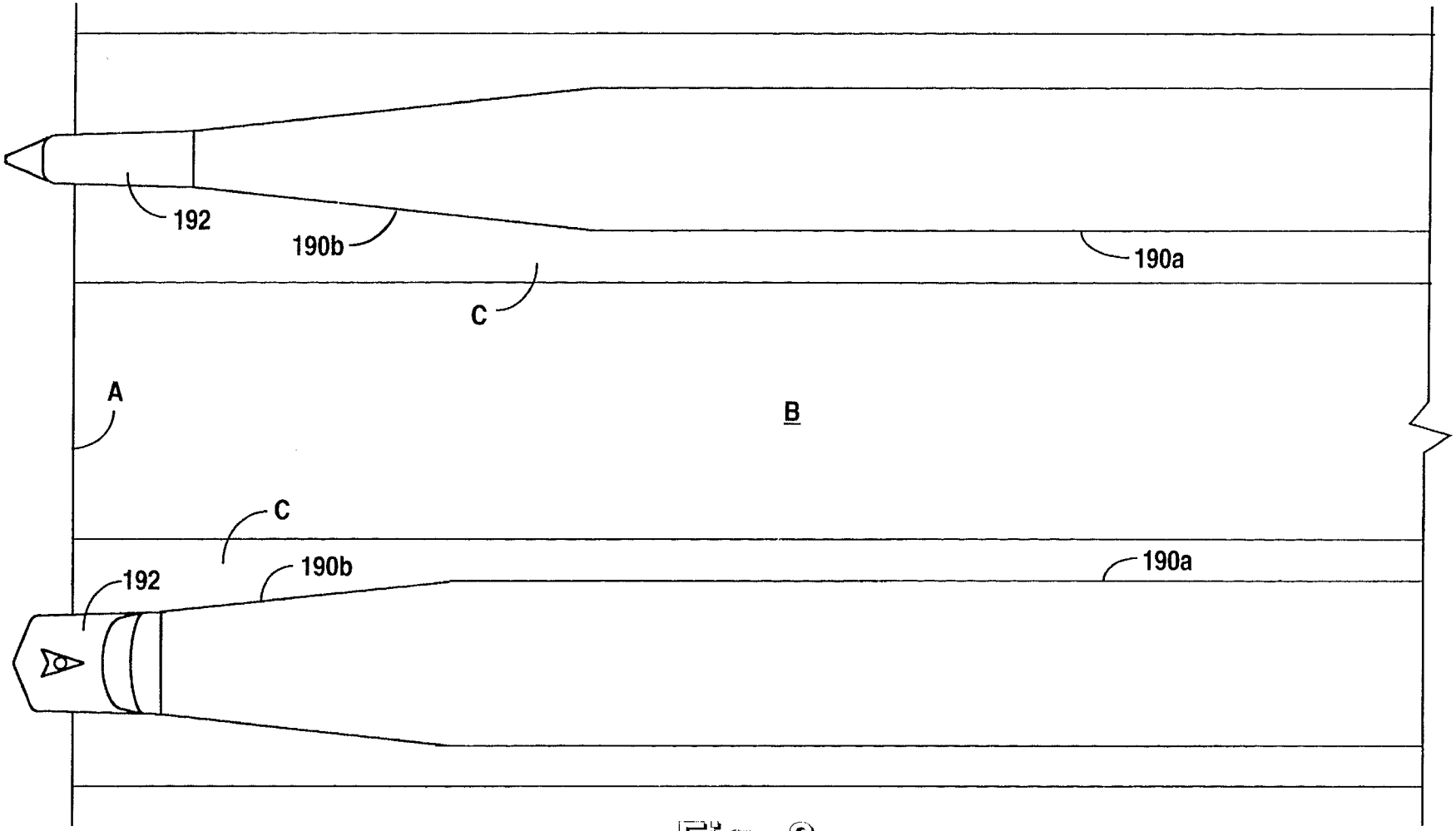
FIG. 8 is a top plan view of the tapered bumper capping and nose detail arrangements for the present invention as implemented on a bowling lane.

FIG. 8 illustrates a plan view of a bowling alley with a lane incorporating applicant's bumper bowling system. More particularly, FIG. 8 illustrates a lane having foul line A, lane bed B and gutters C to either side of lane bed B.

FIG. 8 also illustrates the use of straight sections (190*a*), typically three eighteen-foot straight sectors placed end to end of rail (110). However, within about 3 feet of foul line A, a tapered section (190*b*) begins. The structure of the hardware is the same; it is just tapered in from either side of adjacent gutters in the manner set forth in FIG. 8. The reason for the taper is to allow room for individual to swing a ball over a gutter, angled toward the center of the lane.

Figure 9A:
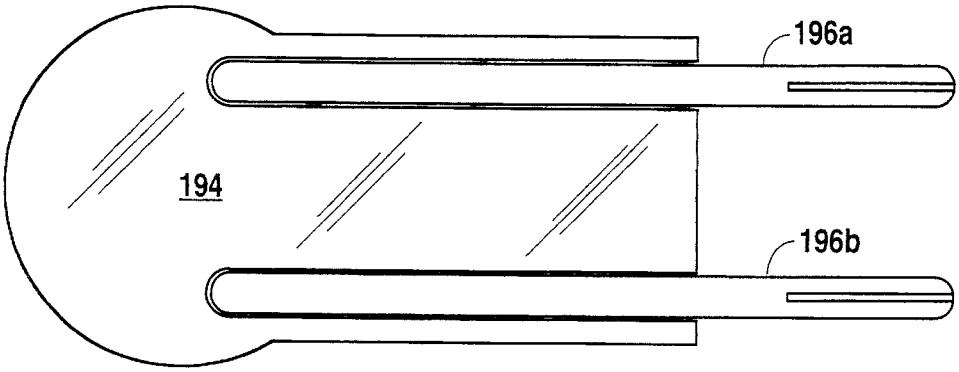
FIG. 9*a* is a detailed top view of the light connection plug utilized on the signal means for the present invention.
Figure 9B:
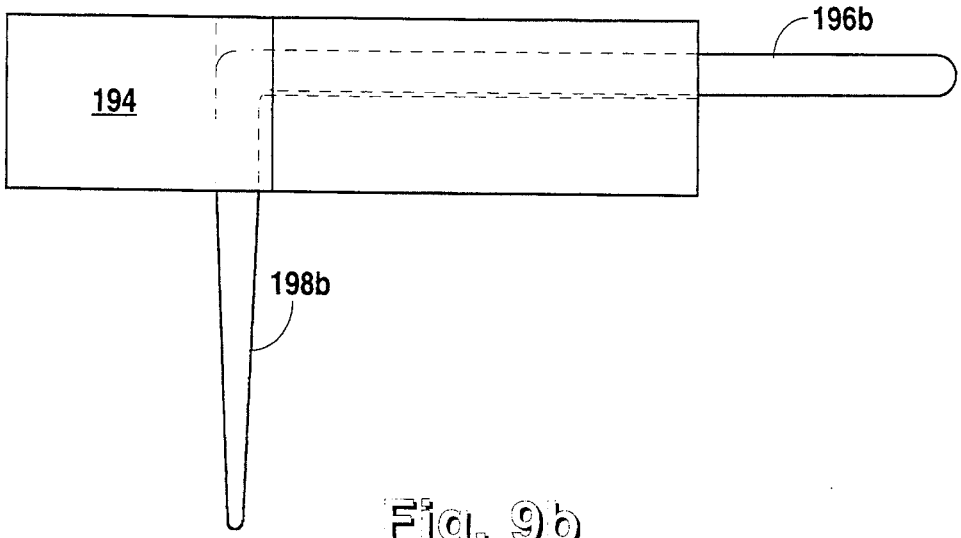
FIG. 9*b* is a detailed side view of the light connection plug of the present invention.

Additional details of the hardware of Applicant's system can be appreciated with reference to FIGS. 9*a* and 9*b*. In particular FIGS. 9*a* and 9*b* illustrate the use of connector plug (194) having legs (196*a* and 196*b*) and prongs (198*a* and 198*b*). Connector plug (194) is typically made of clear plastic and legs (196*a* and 196*b*) of stainless steel or copper bend 90° to join pointed prongs (198*a* and 198*b*). To recap for a moment, the nature of signal means (108), it is typically solid, flexible, plastic tubes with connecting wire and light sources imbedded inside. It typically comes in one-foot sections, each one-foot section containing individual bulbs wired up in series. The user is thus capable of cutting the light tube (108) into one-foot, two-foot, three-foot or more sections and connecting those individual sections up in parallel with one another to join to a standard power source. The use of the connector plug (194) illustrated in FIGS. 9*a*–9*c* help facilitates this by providing pointed prongs (198*a* and 198*b*) insertable into signal means (108) when the light tube is cut to join the wire connecting the individual lamps. Legs (196*a* and 196*b*) are slotted to engage a wiring harness that will connect each of the series run lamp sections in parallel with one another. This allows the system of the present invention to operate individual one-foot (two-foot, three-foot, etc.) sections of signal means (108) independent of or together with additional discreet sections. Applicant could, of course, use two, three or more foot sections or combine one, two or three or more foot sections to provide a variety of combinations of signal means (108).

Figure 10:
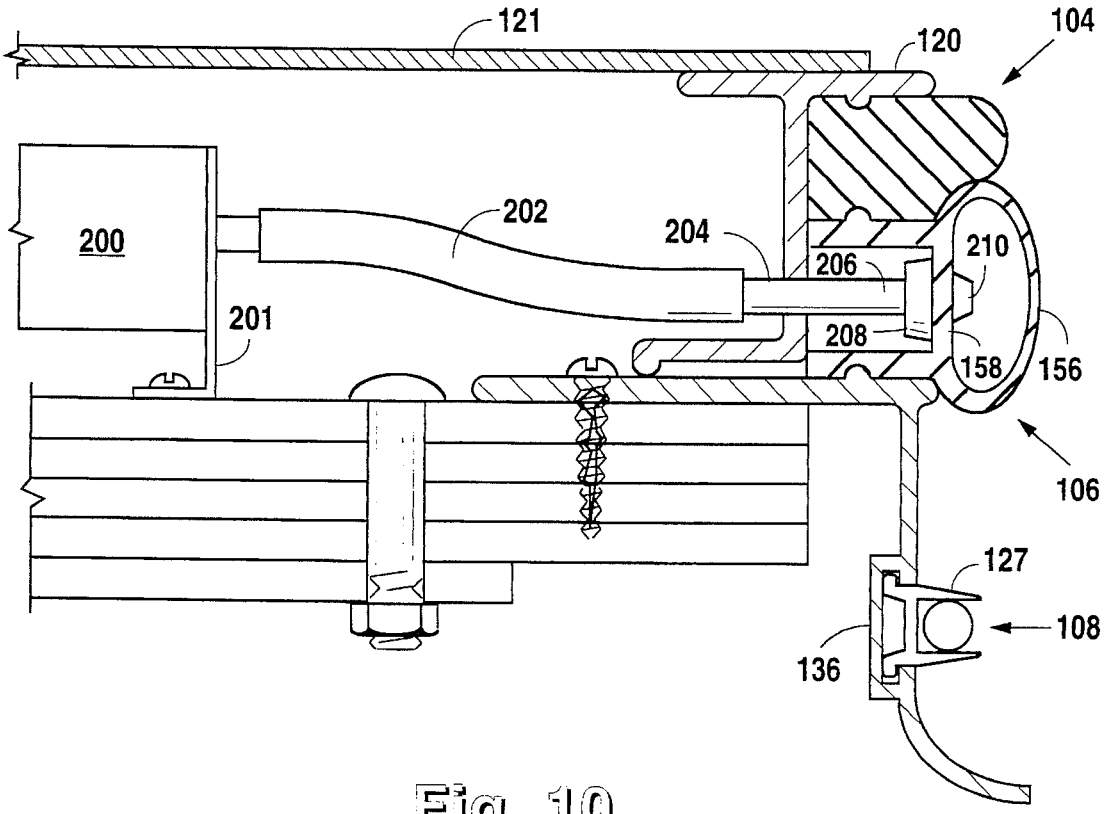
FIG. 10 is a detailed cross-sectional view of the bumper and air tube arrangement of the present invention showing the air switch means for the present invention.

FIG. 10 illustrates the use of sensor means (106), here an air tube, in conjunction with an air switch (200). Air switch (200) is mounted to support member (123) through a bracket (201) anchored typically to support member (123) with a standard fastener. Air switch (200) is activated by air pressure waves generated in sensor means (106) when a bowling ball strikes it. Specifically, a bowling ball striking sensor means (106) will generate an air pressure wave that will pass through tube (156) into straight section (206) of nipple (204) and through supply tube (202) into air switch (200) to trigger a closure or opening, as the case may be, of an electrical circuit. Air switch (200) is an off-the-shelf item; for example, a typical air switch may be provided by master signal as model no. 16NO.

Figure 11A:
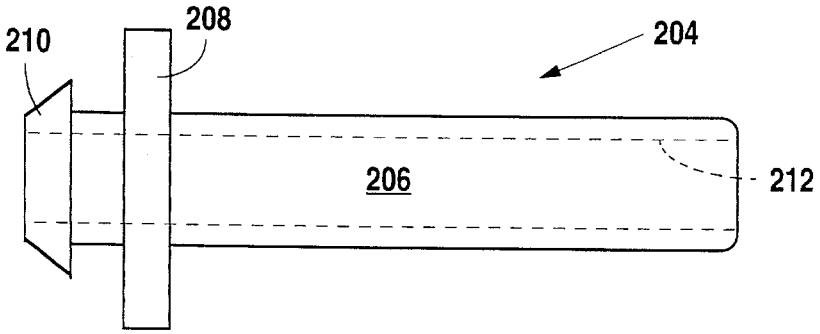
FIG. 11*a* is a detailed side view of the nipple utilized in the air tube of the present invention.
Figure 11B:
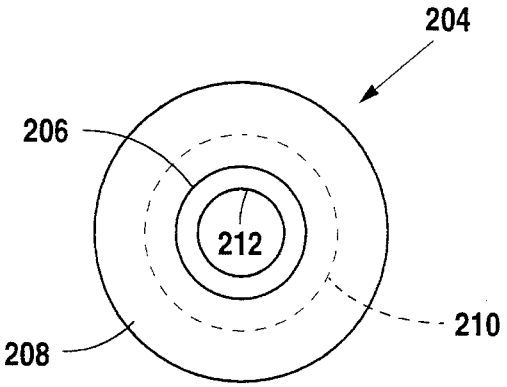
FIG. 11*b* is a detailed end view of the nipple described in FIG. 11*a*.

FIGS. 11*a* and 11*b* illustrate the configuration of nipple (204) and viewed in conjunction with FIG. 10 the manner in which the nipple joins sensor means (106) at back wall (158) of tube (156). More specifically, FIGS. 11*a* and 11*b* illustrate nipple (204) having straight section (206) engagable with the distal end of supply tube (202), supply tube (202) being connected at its proximal end to air switch (200) in the manner set forth in FIG. 10. Nipple (204) has at proximal end thereof a flange (208) and a head (210) with a gap therebetween. Head (210) has a taper cross section as seen in FIG. 11*a* to pop through ready-made holes in back wall (158) to capture the sections adjacent to hole in back wall (158) between the adjacent inner surfaces of head (110) and flange (108) in a substantially air-tight manner. Each rail assembly (one rail assembly per lane) typically would have 12 air switches approximately 3 feet apart. Air pulses are transmitted through chamber (212) of nipple (204) into air switch (200) from the inside of tube (156) as a pressure wave when it is struck by a bowling ball.

Figure 9C:
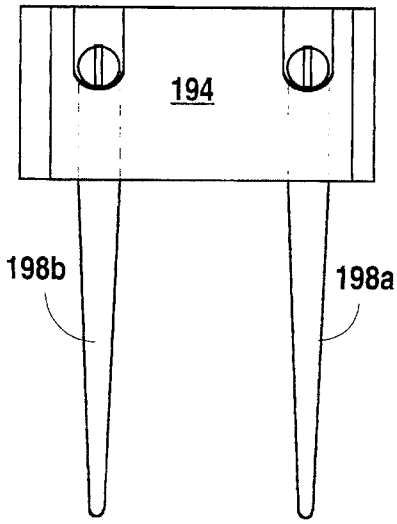
FIG. 9*c* is a detailed end view of the light connection plug of the present invention.

A multiplicity of independent air tube sections are used, each section with its own switch, to match the sections of signal means (108) connected as set forth above with reference to FIGS. 9*a* –*c*. That is, suppose three-foot sections of signal means (108) are connected in parallel such that they may be individually controlled. Adjacent three-foot sections of sensor means (106), here air tubes, would be independently matched adjacent the sections of signal means. A microprocessor/CPU receiving signals from air switches of known location on a lane may correlate the signal with the known location of the activated signal means. This will be discussed in further detail below with reference to the control circuitry and software of Applicant's unique bumper bowling system.

Figure 12:
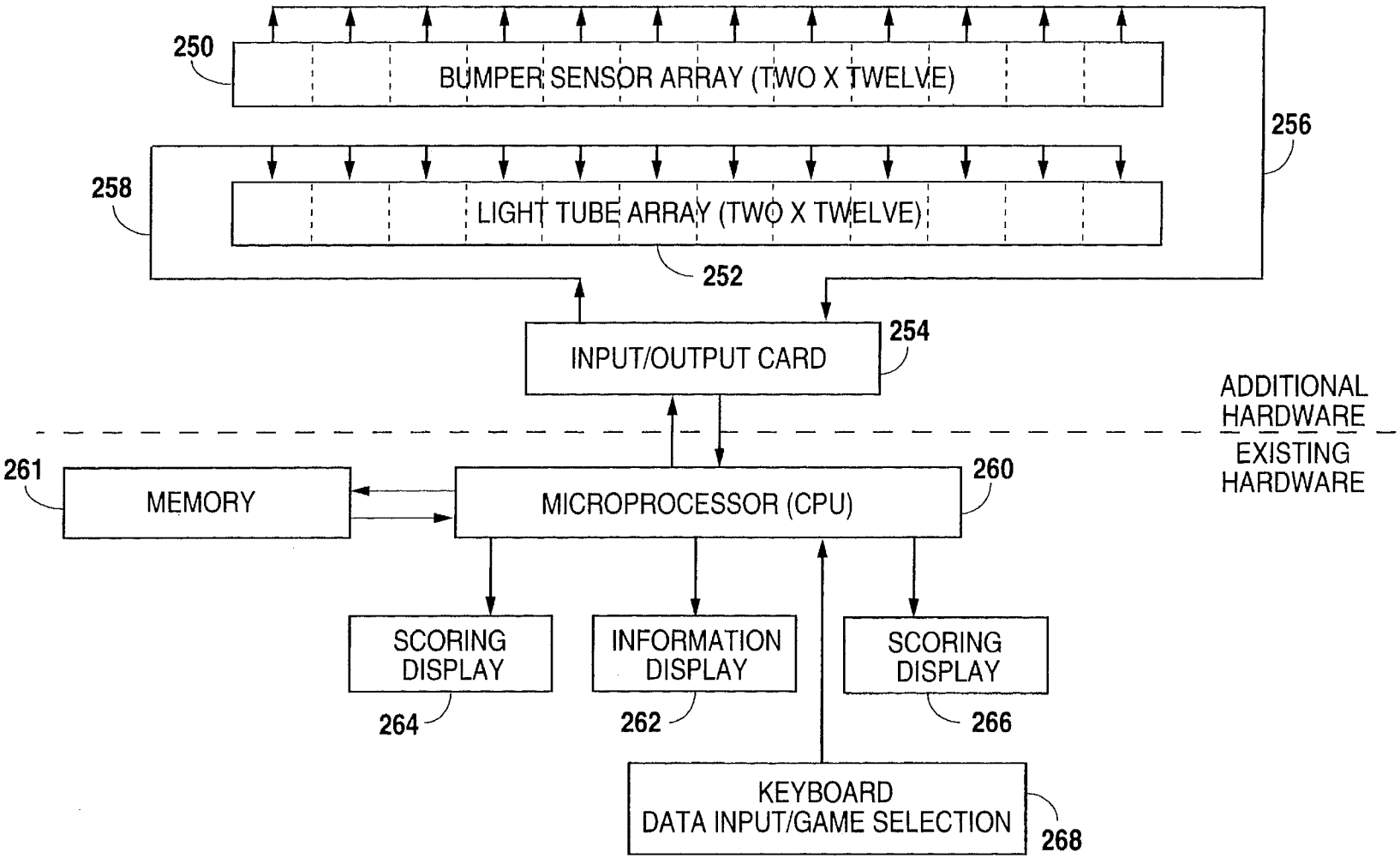
FIG. 12 is a schematic block diagram of the control system of the present invention.

Reference is now made to FIG. 12 for a detailed description of the control circuitry associated with the apparatus of the present invention. FIG. 12 schematically represents bumper sensor array (250) and light tube array (252) as linear arrangements of discrete components. In practice, bumper system sensor array (250) would preferably be comprised of two separate linear sensor tracks as described earlier, one associated with each side of the bowling lane. Likewise, light tube array (252) would preferably be comprised of an assembly of linear light tracks consisting of discrete light elements. In the preferred embodiment, there would be two linear light tube tracks, one on each side of the lane. In an alternative preferred embodiment, there would be a total of six linear light tube arrays, three on each side of the lane, each of the three arrays on each side of the lane comprising a different color. Alternate further to this arrangement, a single light tube array on each side of the lane could incorporate three distinct color lights within each discrete light element.

In theory, bumper sensor array (250) and light tube array (252) could be comprised of any number of discrete sensor components and discrete light components. In practice, however, it has been found that an arrangement of twelve discrete sensor and light components arranged linearly along each side of the bowling lane provide appropriately-sized targets and sensor capabilities for the skill levels of the average bowler. A greater number of discrete sensor and light sections would allow for smaller, more difficult target areas but, after a point, these become unreasonably difficult to hit. Likewise, the fewer the number of discrete component elements, the larger the minimum target size can be and the less challenging the game. The arrangement of twelve sensor and light elements along each side of the lane has been found to provide a target area that can be increased in size by combining two or three discrete components into a single target area. As described in more detail below with respect to a number of the game methods of the present invention, target areas can be created that rely upon a single discrete sensor and light element, a combination of two sensors and two light elements, or a combination of three sensors and three light elements. The higher the skill level of the bowler, the smaller the target and the fewer discrete components involved.

In addition, it should be noted that for reasons deriving from the fact that there are both left-handed and right-handed bowlers and the fact that skill levels do not normally differentiate between the left and right-hand sides of a bowling lane, the preferred embodiment utilizes parallel, duplicately structured sensor and light arrays along each side of the lane. In other words, there are 12 sensors on each side of the lane, giving a total of 24 sensor areas, as well as 12 light elements on each side of the lane, giving a total of 24 lights; but the sensors and the lights on one side of the lane are arranged to be electrically parallel with corresponding sensors and lights on an opposite side of the lane at the same distance from the bowler. This simplifies the implementation of the present invention in a number of respects.

As indicated, bumper sensor array (250) is comprised of discrete bumper sensor elements, each associated with a particular location along the length of the bowling lane. Each of these sensor section provides a distinct switch signal appropriate for identifying when a bowling ball strikes the bumper at that particular element's location. These distinct switch signals are all provided to input-output card (254), which receives each of these sensor signals separately and conveys the separate signals to an appropriate input buss on microprocessor/CPU (260). The switches (not shown in FIG. 12) provide a logical high or low signal to input/output card (254) in a manner that allows input/output card (254) to provide microprocessor/CPU (260) with two 8-bit words for input. As there are 12 discrete sensor signals, 12 bits of the combined 16 bits in the two 8-bit words are utilized for the purpose of receiving the condition of the sensor switches. Any discrete value of the two 8-bit words provides microprocessor/CPU (260) with information sufficient to identify whether or not contact with the bumper has occurred and at what location such contact has occurred. When utilized in conjunction with the method step of directing a bowling ball at a particular target area, microprocessor/CPU (260) merely has to compare the known information associated with the established target area with the sensor switch information received from input/output card (254).

As further described below, microprocessor/CPU (260) controls light tube array (252) by way of input/output card (254). Again, light tube array (252) is comprised of discrete light elements which must each be individually addressed by input/output card (254) through instructions from microprocessor/CPU (260). In the preferred embodiment, microprocessor/CPU (260) provides two 8-bit words to input/output card (254), which actuates the on/off configuration of each element in light tube array (252).

It is understood that in an original equipment system, input/output card (254) could be incorporated into the physical component described generally as microprocessor/CPU (260). Input/output card (254) provides standard parallel coupling between microprocessor/CPU (260), the sensor switches of bumper sensor array (250), and the on/off switches that control the discrete light elements in light tube array (252).

Again, as described in more detail with a discussion of the various game methods of the present invention, the generic sequence of events controlled by the system schematically represented in FIG. 12 initially involves the presentation of a target area through the activation of one, two, or three light tube elements in light tube array (252). This activation of one, two, or three light elements at a specified (or random) locations in light tube array (252) is determined by an output from microprocessor/CPU (260) of a specific combination of the two 8-bit word output signals to input/output card (254). Input/output card (254), thereafter, in response to this discrete 16-bit signal, activates the appropriate light switches to illuminate the discrete light elements selected in light tube array (252). The bowler, in response to the presentation of a target area, then directs the bowling ball at that area in the hope of contacting the target and impacting upon bumper system sensor array (250) on the discrete element(s) within sensor array (250) positionally associated with the discrete elements in light tube array (252). In other words, if, for example, three discrete elements in light tube array (252) are illuminated, then the corresponding three elements in sensor array (250), if activated by ball contact, would provide the necessary information for microprocessor/CPU (260) to confirm that the target was hit. Specifically, if the ball contacts any of the three discrete sensors in sensor array (250), sensor switches (not shown) provide a logical high-voltage value through input/output card (254) to microprocessor/CPU (260) in the form of the aforementioned 16-bit coded signal. Any coded signal not indicative of the ball contacting one of the three target sensor elements would confirm to microprocessor/CPU (260) that the target was in fact not hit. Scoring would, thereafter, continue based upon the confirmation of a hit or non-hit on the target area, and the game method of play selected.

Again, as described in more detail with the various game play methods of the present invention, microprocessor/CPU (260) could, upon confirmation of a target hit, activate a pre-programmed sequence of linear light tube array (252)

displays confirming to the bowler that the appropriate target area was contacted and that the appropriate scoring would, thereafter, be carried out.

The process described above is accomplished to a great extent in automatic fashion by microprocessor/CPU (260), because the input from bumper sensor array (250) immediately dictates appropriate outputs to light tube array (252), as long as the bowler has first selected a programmed sequence of events to be carried out in microprocessor/CPU (260) by means of some game selection input mechanism.

Reference is again made to FIG. 12 for a description of the additional elements of the control system of the present invention that interact with microprocessor/CPU (260) in a manner that allows the participating bowlers to select the appropriate game method to be played as well as to identify the names and skill levels of the bowlers involved and to direct scoring information to the appropriate displays. Connected to microprocessor/CPU (260) is data input/game selection keyboard component (268) that, in most cases, is simply the standard keyboard entry means available with standard bowling lane automatic scoring systems. Typically, this alphanumeric keyboard provides the capacity to input the initials of the bowlers, skill levels, and other abbreviated alphanumeric information. This input is generally made in response to prompts on information display (262), which in the present invention, in addition to the standard prompts and requests for information, provides prompts for game method selection.

In addition to information display (262), the typical bowling lane automatic scoring system incorporates two additional scoring displays (264) and (266), each appropriately positioned above one of the two lanes typically paired together in the bowling alley. Scoring displays (264) and (266), because of their position, are generally limited to providing score information only and do not lend themselves to providing prompts for the input of information, data, or game selection. In any event, microprocessor/CPU (260) is structured so as to drive both information display (262) and scoring displays (264) and (266). In the preferred embodiment, microprocessor/CPU (260) is an Intel 386SX based microprocessor system which is fully capable of driving the scoring and information displays as described and receiving information by well known methods from the various other inputs identified above for the present invention.

As mentioned above, it is anticipated that the system of the present invention could be implemented through either original equipment manufacture and installation or through retrofit to an existing bowling alley electronic scoring system. It is anticipated that in most cases the system will be retrofit, since it has the capacity to utilize an existing electronic scoring system to its full extent. The process of retrofitting the present system to an existing bowling alley electronic scoring system involves re-programming a microprocessor/CPU (260) already present in the existing electronic scoring system, again typically being an Intel 386 based system, and additionally providing input/output card (254) as an interface device between the existing system and the newly-introduced lane hardware of the present invention. Re-programming allows use of the existing scoring and information displays (262), (264), and (266) described above as well as the existing keyboard means (268) and memory (261) for inputting data and game selection. No additional microprocessor hardware is required in a retrofit environment once re-programming of microprocessor/CPU (260) is effected. The only additional hardware associated with the system, therefore, in a retrofit environment involves input/output card (254) and the associated lane hardware.

It should be noted that there are additional hardware components in the typical automated bowling alley system that are controlled by microprocessor/CPU (260), though not disclosed in FIG. 12. These standard assemblies include (in addition to the scoring system described) a means for detecting the number of pins having been knocked down, controlling and manipulating the standard bowling lane pin-setting devices, ball returns, pin resets, etc., identifying movement of the bowler past the foul line on the lane, and identifying the presence of a ball on the lane. All of these functions and sensors normally incorporated into the control systems typically implemented in an electronic scoring system remain in place and remain involved in the bowling process accomplished by the system of the present invention. Again, through the appropriate programming or re-programming of microprocessor/CPU (260), all of the existing controls and inputs associated with standard in-place scoring systems can be manipulated.

In addition to the basic system described above and its capacity to be retrofit into existing electronic bowling lane scoring systems, a number of modifications and additions are readily discernible from the above detailed description of the components and their function. For example, the same microprocessor controlled switching system that controls light tube array (252) and any of its various embodiments, could also be utilized to drive an array of audible signalling devices that, as light tube array (252) might be illuminated, so would an array of audio transmitters, such as speakers, be driven to create audible sounds appropriate for at least the signalling of a bowler's accurate or inaccurate impact on a target area. While in a preferred embodiment it is most always desirable to have the target area illuminated for visual orientation of the bowler, the balance of the functions of light tube array (252) could be supplemented, or in some instances replaced, by an array of audio transmitters. It is anticipated that pre-programmed patterns of musical or alarm-type audio signals could be generated in response to various results during the play of the methods of the present invention. These audio signals could be as simple as fixed tones generated whenever a light section of light tube array (252) is illuminated, or could be as complex as musical melodies that are played when a target area is struck and the maximum number of pins are knocked down. It is clear that a great variety of audible signals could be implemented and would be subject only to variations in the well known microprocessor programming methods for implementation.

Further programming modifications permit an additional, unique aspect of the method of game play of the present invention. Extended use of memory (260) associated with microprocessor/CPU (260) allows a bowler to "record" his or her play of a game and permits a second bowler to "retrieve" this pre-recorded play at a later time in simulated direct competition. Such use of memory (261) even permits play against oneself through "recording" of earlier games.

In addition, the preferred embodiment of the present invention has been described as incorporating two 8-bit words for input of bumper sensor data into microprocessor/CPU (260), and two 8-bit words for output control signals generated by microprocessor/CPU (260). It should be apparent to those skilled in the art that additional input and output signals duplicating the digital word structure of those described in the preferred embodiment could be implemented to increase the data received and manipulated by microprocessor/CPU (260) and to increase the range of audio or visual systems under the control of microprocessor/CPU (260). Thus, the invention is not limited by the number of elements described for either bumper sensor array (250)

or light tube array (252). Appropriate increases in the number of inputs and outputs and the corresponding, microprocessor programming required for the handling of such inputs and outputs, is contemplated.

Reference is again made to the various figures described above for detailed descriptions of a number of methods associated with the play of bowling games based upon the apparatus and system of the present invention.

In its simplest application, the apparatus and system of the present invention may be utilized to effectively play the standard game of bowling which, for the purposes of this disclosure, will be referred to as "Classic Bowl." Under the Classic Bowl method, the bowling game is played according to standard, well known rules and according to a utilization of the standard confines of the bowling lane. In order to simulate the standard bowling lane configuration, the present invention acknowledges ball contact with the bumpers used in the present invention to be "gutter balls" and will direct the reset of any pins knocked down after such bumper contact in anticipation of the next ball or the next frame. For example, if in the first of two balls typically rolled in a frame the ball contacts a bumper in advance of striking the pins, all pins are reset as if the ball had, in fact, fallen into the gutter and had not struck any pins. The second ball of the frame is then rolled as would ordinarily be done. If the ball contacts a bumper during the second ball of a frame, any pins thereafter knocked down are not counted and the bowler's score is simply those pins legally knocked down during the first ball of the frame. Of course, any balls rolled without contact with the bumpers are scored as in the standard game of bowling. The maximum number of points under the confines of the Classic Bowl rules is 300.

A variation of the Classic Bowl rules referred to above is, for the purposes of the present disclosure, referred to as "Gutter Free" bowling. In this arrangement, a bowling ball may permissibly be bounced off of the bumpers on either side of the lane to knock down pins and to score exactly the number of pins as are toppled. Basically, the rules are identical to the Classic Bowl game, with the exception that no "gutter balls" are rolled and every ball, if it meets any pins at the end of the lane, is counted. The maximum number of points under the Gutter Free rules is still 300; but, in most circumstances, the bowler would always receive some points for having knocked down pins. For bowlers who might occasionally throw "gutter balls," therefore, the average score under the Gutter Free rules would be higher.

Another variation of the Classic Bowl rules that relies upon the use of the bumpers is, for the purposes of the present disclosure, simply referred to as "Bumper Bowl." Under Bumper Bowl rules, the bowler is required to strike the bumper at least once in advance of contacting any of the pins at the end of the lane. Under these rules, shots which do not first contact the bumper count as gutter balls and any pins knocked down are reset or cleared as if a gutter ball had been thrown. Here again, the maximum number of points under this variation of the standard rules would be 300. Bumper Bowl rules, however, modify significantly the skills involved in obtaining a high score. Whereas in both Classic Bowl and Gutter Free bowl, standard contact points effective for knocking down the greatest number of pins are well known, these contact points are now altered such that "bumper shots" become more difficult. Otherwise, the rules in Bumper Bowl as far as scoring, frames, number of balls, etc., all remain the same.

A fourth variation game method of the present invention more completely utilizes the features of the apparatus and system of the present invention. This fourth variation, which for the purposes of the present disclosure will be described generally as the "Bowlistic" rules, involves the presentation of target areas on the bumper and light array systems that the bowler must strike in order to increase the number of pin count points accumulated. As described above, target areas are presented consisting of one, two, or three target elements according to the bowler's skill level. A highest skill level (level 1) involves the presentation of targets comprised of a single, three-foot lighted bumper section. Skill level 2, easier than skill level 1, involves the presentation of two such sections so as to provide a 6-foot lighted bumper target. Finally, a third and easiest level (level 3) involves the presentation of three bumper sections to provide a nine-foot lighted bumper target.

In any case with the Bowlistic rules, the score of the bowler is doubled (or tripled, etc.) if the appropriate target area is struck in advance of the ball contacting the pins. If the target area is not appropriately struck prior to contacting the pins, then the bowler is given only such pin count as might normally be assigned under the standard bowling rules. The Bowlistic rules, therefore, are the same as the Bumper Bowl rules insofar as number of frames, number of balls per frame, progress of the game, etc., and differ insofar as a specific bumper target is required to be struck in order that the pin score be doubled. The maximum number of points, therefore, in any level of the Bowlistic rules game would be 600.

The positions of the targets under the Bowlistic rules vary according to the type of game selected. These variations include random target positioning, progressive target positioning from a location nearest the bowler to a location furthest from the bowler, or even moving targets wherein the bowler must anticipate the position of the target when the ball meets the target down the lane. It is anticipated that in the preferred embodiment the bowlers would be able to select, prior to the start of play, which particular Bowlistic target manipulation would occur.

Finally, in a fifth variation of the game rules, which for the purposes of the present disclosure is referred to as the "Bowlitz" rules, the objective is, again, to strike the bumper at a specific target in advance of contacting the pins. Rather than simply doubling a score, however, as in the Bowlistic rules, each bumper position in the Bowlitz rules is marked or indicated as having a specific value from one through ten. If the bowler contacts the bumper in advance of striking the pins, then the number value associated with the bumper target struck would be added to the total number of pins knocked down for that ball. Thus, for example, in the first ball of a frame, the bowler strikes a bumper indicated as having the number value six, then six pins would be added to whatever pin count is achieved through actual contact of that ball with the pins. The maximum pin count per frame, therefore, would be a 20-pin count and, thus, the maximum number of points for the game would be double the usual 300 for a total of 600. The bumper values assigned in the Bowlitz rules could change randomly for each frame as bowled; or, in an alternative method of play, the bowler could specify the target value according to the number of additional pin count points needed at that point in the game.

Applicant's bumper system, with a multiplicity of segmented signal means and sensors, can be mounted on a movable or retractable system such as the devices disclosed in the prior art.

It is understood that various other game rules, utilizing the apparatus of the present invention and based upon the descriptions of the above-mentioned game play methods, could be anticipated. The methods described herein are not intended to be limiting and their disclosure is anticipated to lead to other variations that fall within the confines of the basic play.

What is claimed is:

1. A system for use with a bowling lane, the lane having a first edge and a second edge and a first end and a second end, the second end for receiving pins thereon, the lane capable of supporting a rolling, bowling ball on the surface thereof, the system comprising:

first bumper means adjacent the first edge of the lane for deflecting a ball leaving the lane back onto the lane;

second bumper means adjacent the second edge of the lane for deflecting a ball leaving the lane back onto the lane;

first sensor means to detect a ball striking said first bumper means;

second sensor means to detect a ball striking said second bumper means;

first signal means located adjacent the first edge of the lane capable of emitting a signal to the user;

second signal means capable of emitting a signal to the user wherein said first and said second signal means each are comprised of a multiplicity of linear sections;

first frame means for permanently locating said first bumper means, said first sensor means and said first signal means adjacent the first edge of the lane to the floor; and second frame means for permanently locating said second bumper means, said second sensor means and said second signal means adjacent the second edge of the lane and to the floor.

2. The system of claim 1, wherein both said first and second signal means include means capable of selectively indicating a linear segment of said first and second signal means.

3. The system of claim 2, wherein said first and second signal means include means capable of signaling contact between a ball and said first and second sensor means, respectively.

4. The system of claim 1 further including a scoring display.

5. The system of claim 4 further comprising control means, said control means, including game selector means and a microprocessor, the microprocessor for receiving a user-selected game selection command from the game selector means and capable of controllingly engaging said first and second signal means and the scoring display as a function of the game selected and signals input into the microprocessor from said first and second sensor means.

6. The system of claim 5, wherein the microprocessor of said control means include means capable of selectively indicating at least one of the linear segments of said first and second signal means by energizing the selected segment of said first or said second signal means in response to commands received from the game selector means and said first or said second bumper means and further include means capable of selectively controlling the score display as a function of the game selection command and signal received from said sensor means.

7. The system of claim 5, wherein the microprocessor of said control means include means capable of selectively handicapping one player from other players on the basis of commands received from the game selector means and selectively controlling signals to the scoring display.

8. The system of claim 5, wherein the microprocessor, include means capable of generating a zero score signal to the scoring display when either said first or said second sensor means is contacted by the bowling ball.

9. The system of claim 5, wherein the microprocessor include means capable of activating said first and said second signal means after a ball crosses the second end of the bowling lane.

10. The system of claim 5 wherein said second sensor means each are divided into a multiplicity of linear segments, each segment having a switch means cooperating with said control means and wherein the microprocessor of said control means is capable of selectively controlling the scoring display as a function of the game selected and signals switch activated and received from segments from the multiplicity of segments of said first and second sensor means.

11. The system of claim 1, wherein said first and said second signal means is a series of discreet light sources linearly arranged generally parallel to said first and said second bumper means and laterally adjacent thereto.

12. The system of claim 11 further comprising a scoring display.

13. The system of claim 12 further comprising control means, including game selector means and a microprocessor, the microprocessor for receiving a user-selected game selection command from the game selector means for controllingly engaging said first and second signal means and the scoring display as a function of the game selected and signals input from said first and said second sensor means.

14. The system of claim 13, wherein the microprocessor of said control is capable of selectively energizing some of the discrete light sources of said first and said second signal means as a function of commands received from the game selector means and input signals received from said first and said second sensor means.

15. The system of claim 1, wherein said first and said second frame means each further include a first and a second rail for fixedly supporting said first and said second bumper means, said first and said second sensor means, and said first and said second signal means, and a first and a second mounting bracket for mounting the first and second rails thereon and for affixing the first and second rails to the floor such that the first rail is adjacent the first edge of the lane and the second rail is adjacent the second edge of the lane.

16. The system of claim 15, wherein said first bumper means is solid rubber and said first sensor means lies proximal said first bumper means such that a ball leaving the first edge of the alley first contacts said first sensor means and wherein said second bumper means is solid rubber and said second sensor means lies proximal said second bumper means such that a ball leaving the second edge of the alley first contacts said second sensor means.

17. The system of claim 15 further comprising means to quickly install, without the necessity of tools, said first and second signal means to the first and second rails.

18. The system of claim 17, wherein the means to quickly install, without the necessity of tools, includes a bracket having means to secure said first and said second signal means and means to attach to the first and the second rails.

19. The system of claim 15, wherein said first signal means is a first series of discreet light sources trending linearly parallel to said first bumper means and said second signal means is a second series of discreet light sources trending linearly parallel to said second bumper means.

20. The system of claim 19, wherein the first series and the second series of discreet light sources are enclosed in a clear, flexible tube.

21. The system of claim 19 further comprising means cooperating with the light sources of said first and second signal means to substantially prevent light rays emitted from said first and second signal means from dispersing into adjacent lane areas.

22. The system of claim 19, wherein the first and second rails further include reflector means to reflect light emitted from the discreet light sources of said first and said second signal means.

23. The system of claim 15, wherein said first and second frame means further include means for randomly spacing the first and second mounting brackets to the first and second rails.

24. The system of claim 15, wherein the first and second rails of said first and second frame means include means to releasably attach said bumper means and said sensor means thereto.

25. The system of claim 1, wherein said first and second bumper means are comprised of solid rubber.

26. The system of claim 1, wherein the solid rubber is a compound of rubber known as Kirkhill Compound #550C3226, having an anticipated life of about five years under normal use, ozone resistant, shore A50 to 60, high rebound with minimal compression set and does not mark objects that rub on the bumper.

27. The system of claim 1, wherein said first and said second bumper means lay adjacent and in contact with said first and second sensor means, respectively, the pair being releasably attached to said first and said second frame means, respectively.

28. The system of claim 1 further comprising means to adjustably space said first and second frame means above the floor.

29. The system of claim 1, wherein said first and said second sensor means comprises an air tube and a pressure activated switch.

30. The system of claim 29, wherein said first and second bumper means are made of solid rubber.

31. The system of claim 29, wherein said first and second signal means are comprised of a first and second series of discreet light sources enclosed within a first and second clear tube.

32. The system of claim 29, wherein said first and said second frame means each further include a first and a second rail for fixedly supporting said first bumper means, said first sensor means, and said first signal means, and said second bumper means, said second sensor means, and said second signal means, and a first and a second mounting bracket for mounting the first rail and the second rail, respectively, thereon and for affixing the first and second rails to the floor such that the first rail is adjacent the first edge of the lane and the second rail is adjacent the second edge of the lane.

33. The system of claim 32, wherein said first bumper means is solid rubber and said first sensor means lies proximal to said first bumper means such that a ball leaving the first edge of the alley first contacts said first sensor means and wherein said second bumper means is solid rubber and said second sensor means lies proximal to said second bumper means such that a ball leaving the second edge of the alley first contacts said second sensor means.

34. The system of claim 33, wherein said first signal means is a first series of discreet light source segments trending linearly parallel to said first bumper means and said second signal means is a second series of discreet light source segments trending linearly parallel to said second bumper means.

35. The system of claim 34 further comprising means cooperating with the discreet light source segments of said first and second signal means to substantially prevent light rays emitted from said first and second signal means from reaching adjacent lane areas and wherein the first and second rails further include reflector means to reflect light emitted from the discreet light sources.

36. The system of claim 35, wherein said first and second frame means further include means for randomly spacing the first and second mounting brackets to the first and second rails, respectively.

37. The system of claim 36 further comprising means to adjustably space said first and second frame means above the floor.

38. The system of claim 37 further comprising means to quickly install, without the necessity of tools, said first and second signal means to the first and the second rails, respectively.

39. The system of claim 38, wherein the means to quickly install, without the necessity of tools, includes a plastic bracket having means to secure said first and said second signal means and means to attach to the first and the second rails.

40. The system of claim 1, wherein each of said first and said second sensor means is linear and segmented into a multiplicity of discrete sections, each of the discrete units sections having a switch operatively connected therewith such that when a bowling ball contacts one of said unit sections, the switch connected thereto is activated without activating the switches of the non-contacted sections; and wherein each of said first and said second signal means is linear and segmented into a multiplicity of discrete units sections, each unit section capable of being energized separately from the others and corresponding to a unit section of said first and said second sensor means and further including control means having in operative engagement, a microprocessor, the microprocessor having data storage means, game selection means, and a monitor display, said control means capable of sensing the condition of the switches of said sensor means, said control means for selectively controlling signal means and monitor display as a function of user input into game selection means and switch conditions.

41. The system of claim 40 wherein said control means includes means capable of displaying on the monitor the location of the unit of said first or said second sensor means that has been contacted by a bowling ball.

42. The system of claim 40 wherein said control means is capable of energizing said signal means each time a ball has passed the second end of the bowling lane.

43. The system of claim 40 wherein said control means include means capable of providing a multiplicity of different scoring options for contemporaneously play by a multiplicity of players, the players using different scoring options.

44. The system of claim 40, wherein said control means includes means capable of storing scores under user identification code for later recall by a subsequent user.

45. The system of claim 40, wherein said control means include means capable of assigning different scoring values among the units of said first and said second sensor means.

* * * * *